US010285466B2

(12) United States Patent
Princip et al.

(10) Patent No.: US 10,285,466 B2
(45) Date of Patent: May 14, 2019

(54) FOOTBALL HELMET WITH SHELL SECTION DEFINED BY A NON-LINEAR CHANNEL

(71) Applicant: Kranos IP Corporation, Litchfield, IL (US)

(72) Inventors: Michael M. Princip, Winston-Salem, NC (US); James C. Wingo, Austin, TX (US); Jeremy J. Thompson, Temple, TX (US)

(73) Assignee: KRANOS IP CORPORATION, Litchfield, IL (US)

( * ) Notice: Subject to any disclaimer, the term of this patent is extended or adjusted under 35 U.S.C. 154(b) by 0 days.

(21) Appl. No.: 15/987,653

(22) Filed: May 23, 2018

(65) Prior Publication Data

US 2018/0295922 A1 Oct. 18, 2018

Related U.S. Application Data

(63) Continuation of application No. 15/046,622, filed on Feb. 18, 2016, which is a continuation of application (Continued)

(51) Int. Cl.

*A42B 3/20* (2006.01)
*A42B 3/06* (2006.01)

(Continued)

(52) U.S. Cl.

CPC ..... *A42B 3/20* (2013.01); *A42B 3/06* (2013.01); *A42B 3/063* (2013.01); *A42B 3/064* (2013.01);

(Continued)

(58) Field of Classification Search

CPC ..... A42B 3/20; A42B 3/064; A42B 3/127; A63B 71/10

(Continued)

(56) References Cited

U.S. PATENT DOCUMENTS 1,244,559 A * 10/1917 Stocks ..... A42B 3/064 2/411
1,522,952 A 1/1925 Goldsmith (Continued)

FOREIGN PATENT DOCUMENTS

| | | | |
|---|---|---|---|
| GB | 2535639 | A | 8/2016 |
| WO | 9626654 | A1 | 9/1996 |
| WO | 9733494 | A1 | 9/1997 |

OTHER PUBLICATIONS

International Search Report for corresponding parent PCT/US2011/045071, dated Dec. 19, 2011.

(Continued)

*Primary Examiner* — Shaun R Hurley
*Assistant Examiner* — Andrew Wayne Sutton
(74) *Attorney, Agent, or Firm* — Notaro, Michalos & Zaccaria P.C.

(57) ABSTRACT

A football helmet comprising a one-piece shell and an energy absorbing layer includes a crown portion, a front portion, a left side portion, a right side portion, and a rear portion. The shell has a non-linear channel spaced in its entirety from an edge of the shell that partially surrounds and defines a shell section within the front portion such that the shell section is moveable relative to the remainder of the shell upon the shell section receiving an impact energy to dampen the impact energy.

9 Claims, 10 Drawing Sheets

Related U.S. Application Data

No. 13/189,289, filed on Jul. 22, 2011, now abandoned.

(60) Provisional application No. 61/494,522, filed on Jun. 8, 2011, provisional application No. 61/376,818, filed on Aug. 25, 2010, provisional application No. 61/366,703, filed on Jul. 22, 2010.

(51) Int. Cl.
*A63B 71/10* (2006.01)
*A42B 3/12* (2006.01)

(52) U.S. Cl.
CPC ..... *A42B 3/065* (2013.01); *A42B 3/127* (2013.01); *A63B 71/10* (2013.01)

(58) Field of Classification Search
USPC ..... 2/410, 6.8, 411, 412, 414, 425
See application file for complete search history.

(56) References Cited

U.S. PATENT DOCUMENTS 2,140,716 A 12/1938 Pryale
3,039,109 A 10/1958 Simpson
3,086,899 A 4/1963 Smith
3,116,490 A * 1/1964 Zbikowski ..... A42B 3/064 2/414
3,153,792 A 10/1964 Marietta
3,166,761 A 1/1965 Strohm
3,186,004 A 6/1965 Carlini
3,197,784 A 8/1965 Carlisle
3,208,080 A * 9/1965 Hirsch ..... A42B 3/322 2/414
3,273,162 A 9/1966 Andrews, III
3,373,443 A 3/1968 Marietta
3,582,990 A * 6/1971 Frieder ..... A42B 3/06 2/2.5
3,609,764 A 10/1971 Morgan
3,616,463 A 11/1971 Theodore
3,713,640 A 1/1973 Margan
3,761,959 A * 10/1973 Dunning ..... A42B 3/122 137/223
3,843,970 A 10/1974 Marietta
3,872,511 A 3/1975 Nicholas
3,882,547 A * 5/1975 Morgan ..... A42B 3/121 2/414
4,023,213 A 5/1977 Rovani
4,101,983 A * 7/1978 Dera ..... A42B 3/0413 2/412
4,134,155 A 1/1979 Robertson
4,168,542 A 9/1979 Small
4,223,409 A * 9/1980 Lee ..... A42B 3/065 2/411
4,239,106 A 12/1980 Aileo
4,282,610 A 8/1981 Steigerwald
4,287,613 A 9/1981 Schulz
4,300,242 A * 11/1981 Nava ..... A42B 3/063 2/412
4,307,471 A 12/1981 Lovell
4,345,338 A 8/1982 Frieder
D267,287 S 12/1982 Gooding
4,370,759 A 2/1983 Zide
4,404,690 A * 9/1983 Farquharson ..... A42B 3/12 2/420
4,432,099 A 2/1984 Grick
4,466,138 A 8/1984 Gessalin
4,558,470 A 12/1985 Mitchell et al.
4,586,200 A 5/1986 Poon
4,665,569 A * 5/1987 Santini ..... A42B 3/32 2/410
4,856,119 A 8/1989 Häberle
4,937,888 A * 7/1990 Straus ..... A42B 3/003 2/411
4,996,724 A 3/1991 Dextrase
5,035,009 A * 7/1991 Wingo, Jr. ..... A42B 3/121 2/414
5,263,203 A 11/1993 Kraemer
5,271,103 A * 12/1993 Darnell ..... A42B 1/08 2/411
5,450,631 A 9/1995 Egger
5,475,878 A 12/1995 Dawn et al.
5,515,546 A 5/1996 Shifrin
5,518,802 A 5/1996 Colvin
5,544,367 A * 8/1996 March, II ..... A42B 3/00 2/410
5,553,330 A 9/1996 Carveth
5,561,866 A * 10/1996 Ross ..... A42B 3/065 2/410
5,661,854 A * 9/1997 March, II ..... A42B 3/00 2/410
5,732,414 A 3/1998 Monica
5,787,513 A 8/1998 Sharmat
5,794,271 A 8/1998 Hastings
5,799,337 A 9/1998 Brown
5,950,243 A 9/1999 Winters et al.
5,953,761 A 9/1999 Jurga
5,956,777 A * 9/1999 Popovich ..... A42B 3/20 2/412
6,088,840 A 7/2000 Im
6,131,196 A 10/2000 Vallion
6,154,889 A * 12/2000 Moore, III ..... A42B 3/06 2/411
6,189,156 B1 2/2001 Loiars
6,219,850 B1 4/2001 Halstead et al.
6,272,692 B1 8/2001 Abraham
6,282,724 B1 9/2001 Abraham et al.
6,292,952 B1 9/2001 Watters et al.
6,360,376 B1 * 3/2002 Carrington ..... A42B 3/00 2/411
6,378,140 B1 * 4/2002 Abraham ..... A42B 3/064 2/411
D465,067 S 10/2002 Ide
6,658,671 B1 12/2003 Von Holst et al.
D492,818 S 7/2004 Ide
6,934,971 B2 8/2005 Ide et al.
7,089,602 B2 8/2006 Talluri
D528,705 S 9/2006 Ide
7,254,843 B2 8/2007 Talluri
7,328,462 B1 2/2008 Straus
D603,099 S * 10/2009 Bologna ..... D29/106
D603,100 S 10/2009 Bologna
7,673,351 B2 3/2010 Copeland
7,743,640 B2 6/2010 Lamp et al.
7,802,320 B2 9/2010 Morgan
7,832,023 B2 11/2010 Crisco
7,849,524 B1 * 12/2010 Williamson ..... A42B 3/285 2/410
7,954,177 B2 6/2011 Ide
3,069,498 A1 12/2011 Maddux
8,069,498 B2 12/2011 Maddux
8,176,574 B2 5/2012 Bryant
8,201,269 B2 6/2012 Maddux
D681,280 S 4/2013 Bologna
D681,281 S 4/2013 Bologna
8,528,118 B2 9/2013 Ide
8,544,117 B2 10/2013 Erb
8,572,767 B2 11/2013 Bryant
8,640,267 B1 2/2014 Cohen
8,661,564 B2 3/2014 Dodd
8,726,424 B2 5/2014 Thomas
8,776,272 B1 7/2014 Straus et al.
8,813,269 B2 8/2014 Bologna
9,107,466 B2 8/2015 Hoying
9,131,744 B2 9/2015 Erb
D752,821 S 3/2016 Bologna
D752,822 S 3/2016 Bologna
D752,823 S 3/2016 Bologna
9,289,024 B2 3/2016 Withnall
9,314,063 B2 4/2016 Bologna
D764,716 S 8/2016 Bologna
9,498,014 B2 11/2016 Princip

(56) References Cited

U.S. PATENT DOCUMENTS

| | | | | |
|---|---|---|---|---|
| 9,622,532 | B2 | 4/2017 | Tryner | |
| 9,622,533 | B2 | 4/2017 | Warmouth | |
| D787,748 | S | 5/2017 | Bologna | |
| 9,642,410 | B2 | 5/2017 | Grice | |
| 9,656,148 | B2 | 5/2017 | Bologna | |
| 9,756,891 | B1 | 9/2017 | McGhie et al. | |
| 9,763,488 | B2 | 9/2017 | Bologna | |
| 9,770,060 | B2 | 9/2017 | Infusino | |
| 10,143,256 | B2 | 12/2018 | Straus | |
| 10,149,511 | B2 | 12/2018 | Vito | |
| 2001/0039674 | A1 | 11/2001 | Shida | |
| 2004/0025231 | A1 | 2/2004 | Ide | |
| 2004/0045078 | A1* | 3/2004 | Puchalski | A42B 3/324 2/411 |
| 2004/0117896 | A1 | 6/2004 | Madey et al. | |
| 2004/0261157 | A1* | 12/2004 | Talluri | A42B 3/063 2/412 |
| 2005/0241049 | A1 | 11/2005 | Ambuske et al. | |
| 2006/0031978 | A1 | 2/2006 | Pierce | |
| 2006/0242752 | A1 | 11/2006 | Talluri | |
| 2007/0000032 | A1 | 1/2007 | Morgan | |
| 2007/0157370 | A1 | 7/2007 | Joubert des Ouches | |
| 2007/0163158 | A1 | 7/2007 | Bentz | |
| 2007/0266481 | A1 | 11/2007 | Alexander et al. | |
| 2008/0250550 | A1 | 10/2008 | Bologna et al. | |
| 2009/0031479 | A1 | 2/2009 | Rush | |
| 2009/0106882 | A1* | 4/2009 | Nimmons | A42B 3/20 2/414 |
| 2009/0260133 | A1 | 10/2009 | Del Rosario | |
| 2010/0005573 | A1 | 1/2010 | Rudd et al. | |
| 2010/0043126 | A1 | 2/2010 | Morel | |
| 2010/0050323 | A1 | 3/2010 | Durocher et al. | |
| 2010/0180362 | A1 | 7/2010 | Glogowski et al. | |
| 2010/0287687 | A1 | 11/2010 | Ho | |
| 2010/0299812 | A1 | 12/2010 | Maddux | |
| 2010/0299813 | A1 | 12/2010 | Morgan | |
| 2011/0047678 | A1 | 3/2011 | Barth et al. | |
| 2011/0209272 | A1* | 9/2011 | Drake | A42B 3/069 2/411 |
| 2011/0271428 | A1 | 11/2011 | Withnall et al. | |
| 2012/0017358 | A1* | 1/2012 | Princip | A42B 3/064 2/414 |
| 2012/0066820 | A1* | 3/2012 | Fresco | A41D 13/0153 2/463 |
| 2012/0151663 | A1* | 6/2012 | Rumbaugh | A42B 3/065 2/411 |
| 2012/0198604 | A1* | 8/2012 | Weber | A42B 3/125 2/414 |
| 2012/0233745 | A1 | 9/2012 | Veazie | |
| 2012/0317705 | A1* | 12/2012 | Lindsay | A42B 3/062 2/413 |
| 2013/0067643 | A1 | 3/2013 | Musal et al. | |
| 2013/0185837 | A1* | 7/2013 | Phipps | A42B 3/12 2/2.5 |
| 2013/0014313 | A1 | 10/2013 | Erb | |
| 2013/0283504 | A1* | 10/2013 | Harris | A42B 3/127 2/411 |
| 2014/0007322 | A1 | 1/2014 | Marz et al. | |
| 2014/0223641 | A1 | 8/2014 | Henderson | |
| 2014/0223644 | A1 | 8/2014 | Bologna et al. | |
| 2014/0223646 | A1 | 8/2014 | Bologna | |
| 2014/0325745 | A1 | 11/2014 | Erb | |
| 2015/0082520 | A1 | 3/2015 | Cheng et al. | |
| 2015/0157083 | A1 | 6/2015 | Lowe | |
| 2015/0230537 | A1 | 8/2015 | Warmouth | |
| 2015/0250248 | A1 | 9/2015 | Jacobsen | |
| 2015/0335091 | A1 | 11/2015 | Erb et al. | |
| 2015/0335092 | A1 | 11/2015 | Erb | |
| 2016/0021967 | A1 | 1/2016 | Finiel | |
| 2016/0029733 | A1 | 2/2016 | Kovarik et al. | |
| 2017/0135433 | A1 | 5/2017 | Booher, Sr. et al. | |

OTHER PUBLICATIONS

Office Action dated Oct. 30, 2018 in U.S. Appl. No. 15/987,570.
Memorandum Opinion and Order in *Kranos IP Corp. et al.* v. *Riddell, Inc.* (E.D. III. Sep. 12, 2018).
Office Action dated Jan. 11, 2019 in U.S. Appl. No. 16/160,566.
Office Action dated Jan. 11, 2019 in U.S. Appl. No. 16/161,287.
Office Action dated Jan. 11, 2019 in U.S. Appl. No. 16/161,330.
Office Action dated Dec. 26, 2018 in U.S. Appl. No. 16/161,193.
Office Action dated Feb. 8, 2019 in U.S. Appl. No. 16/161,193.
Office Action dated Sep. 26, 2018 in U.S. Appl. No. 15/987,569.
Office Action dated Sep. 27, 2018 in U.S. Appl. No. 15/987,624.

* cited by examiner

FOOTBALL HELMET WITH SHELL SECTION DEFINED BY A NON-LINEAR CHANNEL

CROSS-REFERENCE TO RELATED APPLICATIONS

This application is a continuation of U.S. patent application Ser. No. 15/046,622, filed Feb. 18, 2016, which is a continuation of U.S. patent application Ser. No. 13/189,289, filed Jul. 22, 2011, which claims priority to U.S. Provisional Application No. 61/494,522, filed Jun. 8, 2011, U.S. Provisional Application No. 61/376,818, filed Aug. 25, 2010 and U.S. Provisional Application No. 61/366,703, filed Jul. 22, 2010. Applicant incorporates by reference herein U.S. Provisional Application Nos. 61/494,522, 61/376,818 and 61/366,703 in their entireties.

BACKGROUND OF THE INVENTION

1. Field of the Invention

The present invention relates generally to a protective helmet, and more particularly a helmet for use in contact sports such as American football, lacrosse or hockey.

2. Description of the Related Art

Helmets and other protective headgear are commonly utilized to protect a wearer's head from injury. Typically, helmets are designed specifically for the particular sport or activity. Numerous sports, such as American football, hockey, and lacrosse, require players to wear helmets.

American football helmets have evolved since the inception of football. In the early years of football, football players did not wear helmets or protective headgear. As the number of football player head injuries increased, helmets became a required item of equipment. The football helmet used prior to World War II was primarily a leather cap with ear flaps. Subsequent to World War II, a football helmet was introduced having a hard outer shell made of plastic with a web support mounted in the shell to space it from the player's head. The web support was subsequently replaced with a type of shock absorbing liner or padding.

In addition to the outer shell with interior padding, the conventional football helmet includes a face guard, having either upper or lower side mounts, and a chin protector or strap, that fits snugly about the chin of the player, in order to secure the helmet to the player's head.

In contact sports such as football, helmets provide players a substantial degree of protection against injury to their heads due to impact forces that may be sustained; however, a large number of head injuries, particularly g-force injuries, continue to occur. Rapid acceleration or deceleration of the head (g-forces) has been deemed to be the cause of many sports-related injuries and is the subject of growing concern. When contact is made with the conventional helmet, the rigid outer shell moves as a unit, compressing the padding between the head and the shell on the contact side of the helmet. After some initial compression, the padding begins to move the head. As the entire helmet and head move away from contact, the padding begins to rebound and places increasing force on the head. This process of compressing padding while gradually imparting an increasing load to the head is the method conventional helmets use to address g-force impacts.

It is desirable to have an improved protective helmet which provides increased protection from impact forces sustained by the wearer. It is further desirable to have a protective helmet that provides a reduction of g-forces. It is also desirable to provide an improved sports helmet for contact sports.

SUMMARY OF THE INVENTION

The present application discloses a football helmet comprising a one-piece shell and an energy absorbing layer. The shell includes a crown portion, a front portion, a left side portion, a right side portion, and a rear portion. The shell has a non-linear channel spaced in its entirety from an edge of the shell that partially surrounds and defines a shell section within the front portion such that the shell section is moveable relative to the remainder of the shell upon the shell section receiving an impact energy to dampen the impact energy.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which.

DESCRIPTION OF THE PREFERRED EMBODIMENTS

Figure 1:
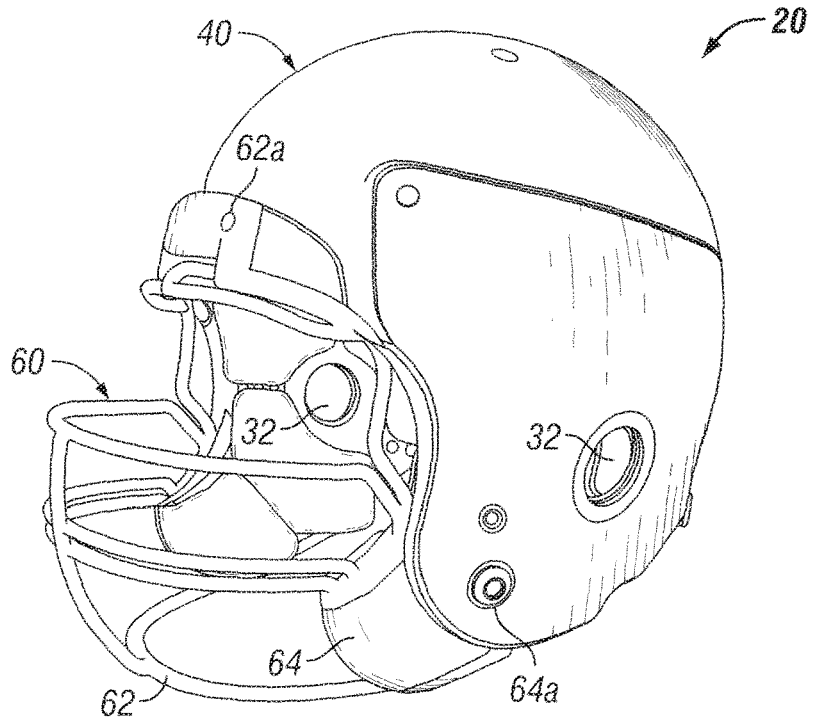
FIG. 1 is a perspective view from the front and side of a protective helmet according to a preferred embodiment of the present invention.

Referring now to the drawings, in which like reference numerals are used to refer to identical or similar elements, a first preferred embodiment of the protective helmet, generally referred to as reference numeral 20, is shown in FIGS. 1-6. The helmet 20 has an inner shell 30 and an outer shell assembly 40. The inner shell 30 is preferably a single, rigid shell having an inner surface 30*a* and an outer surface 30*b*. One or more layers of internal padding or pads 24 are attached, connected or fastened to the inner shell 30 to provide impact absorption. An external energy absorbing layer 50 is positioned between at least a portion of the outer surface 30*b* of the inner shell 22 and the outer shell assembly 40. The protective helmet 20 is designed to dampen the energy of a jarring impact to the outer shell assembly 40 before reaching the hard inner shell 30 by reducing the g-forces. Although the embodiments of the protective helmet illustrated in the figures are football helmets, it is to be understood that the present invention can also be used for other activities or sports including, but not limited to, baseball, hockey and lacrosse.

Figure 3:
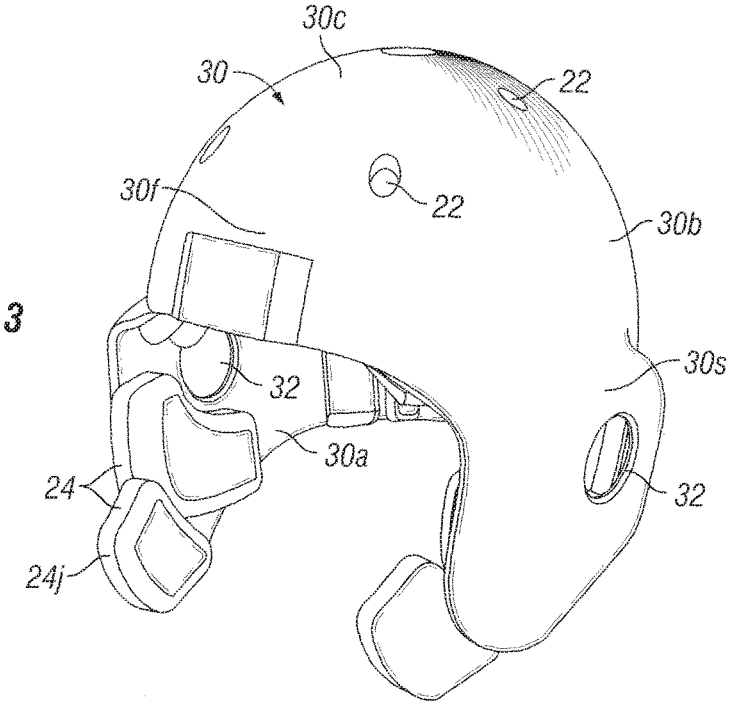
FIG. 3 is a perspective view from a front and side of an inner shell with internal padding.
Figure 4:
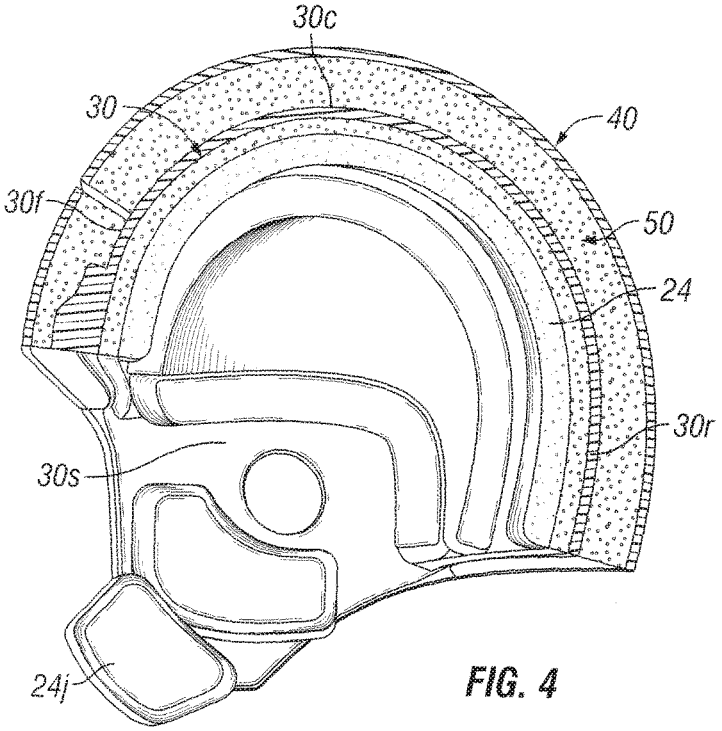
FIGS. 4 and 5 are cross-sectional views of the protective helmet of FIG. 1.

Referring to FIGS. 3 and 4, the inner shell 30 preferably includes a front portion 30*f*, side portions 30*s*, a crown portion 30*c* and a rear portion 30*r*. Preferably, the side portions extend downwardly and forwardly to cover the wearer's ears and a portion of the wearer's cheeks. The inner shell 30 includes a pair of ear holes or slots 32. The inner shell 30 is preferably made of a rigid material of the type known to those skilled in the art as, for example, a rigid plastic such as a polycarbonate, a rigid thermoplastic or a thermosetting resin, a composite fiber or possibly a liquid metal. One preferred material may be acrylonitrile butadiene styrene ("ABS"). The inner shell 30 is preferably molded into the desired shape. While the inner shell 30 is described and shown in the figures as preferably being of unitary single piece construction, it is to be understood that the present invention is not limited to a one piece inner shell.

The internal padding 24 is preferably removable and contacts the inner surface 30*a* of the inner shell 30. The internal padding 24 may comprise a plurality of pads located within the inner shell 30 adapted to contact various portions of the wearer's head, such as the forehead, temples, ears, jaw, crown and back of the head, as is well known to those skilled in the art. Typical utilized padding materials include foam padding, as for example polyurethane foam, rubber foam and PVC nitrile foam. Additionally or alternatively, the internal padding 24 may include an upper suspension system comprising a fully enclosed fluid suspension system that encompasses the entire circumference of the upper head. As compression occurs, the fluid, typically air, is forced out of a controlled air valve, and then filled back with air after impact. Such systems are conventional and well known to those skilled in the art.

Figure 5:
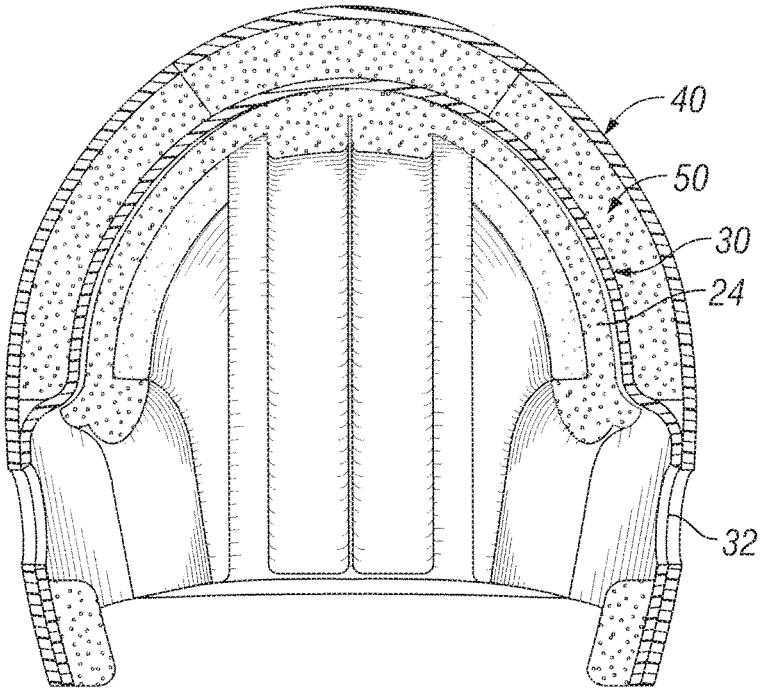
Figure 6:
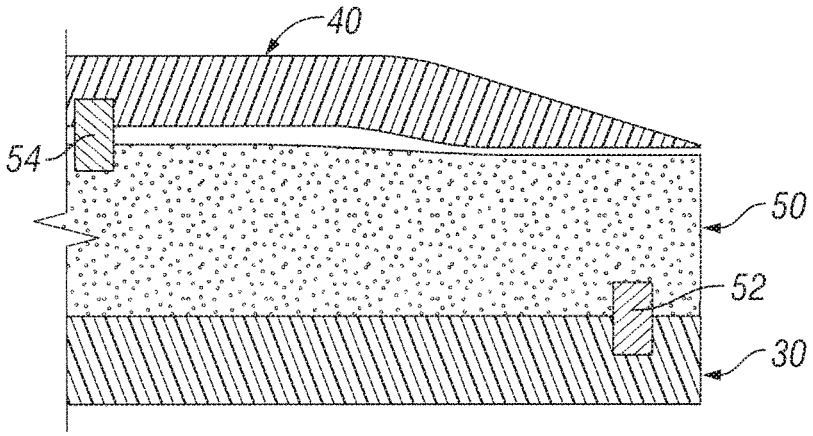
FIG. 6 is a schematic view showing the inner and outer shells with an energy absorbing layer therebetween.

Referring to FIGS. 4-6, the external energy absorbing layer 50 may comprise a cell system consisting of a layer of mini air or gel cells sandwiched between the inner shell 30 and the outer shell assembly 40. The air cell padding may be formed in one or more perforated pads or blankets. The external padding layer 50 contacts the outer surface 30*b* of the inner shell 30 and includes one or more inner fastening points 52 for affixing the padding layer 50 to the inner shell 30, as shown in FIG. 6. The padding layer 50 also includes one or more outer fastening points 54 for affixing the outer shell assembly 40 to the energy absorbing layer 50. The energy absorbing system 50 reduces or dampens the amount of jarring impact transmitted from the outer shell assembly 40 to the inner shell 30.

The outer shell assembly 40 comprises one or more shell panels 42. The shell panels 42 are preferably hard and may be made of a rigid material of the type known to those skilled in the art as, for example, a rigid plastic such as a polycarbonate, a rigid thermoplastic or a thermosetting resin, a composite fiber or possibly a liquid metal. One preferred material may be ABS. The outer shell assembly 40 protects the mini air (gel) cells blanket forming the external energy absorbing layer 50.

In the preferred embodiment of FIGS. 1-6, the outer shell assembly 40 is attached to the external energy absorbing layer 50 and is only attached to the inner shell 30 at, or around the ear holes as shown in FIG. 5. However, it is to be understood that the outer shell assembly 42 does not have to be directly attached to the inner shell 30, but instead can be indirectly attached to the inner shell 30 via the external energy absorbing layer 50 as described above. Such an arrangement directs and dampens all of the impact energy into the external padding system 50 outside of the inner shell 30.

Figure 2:
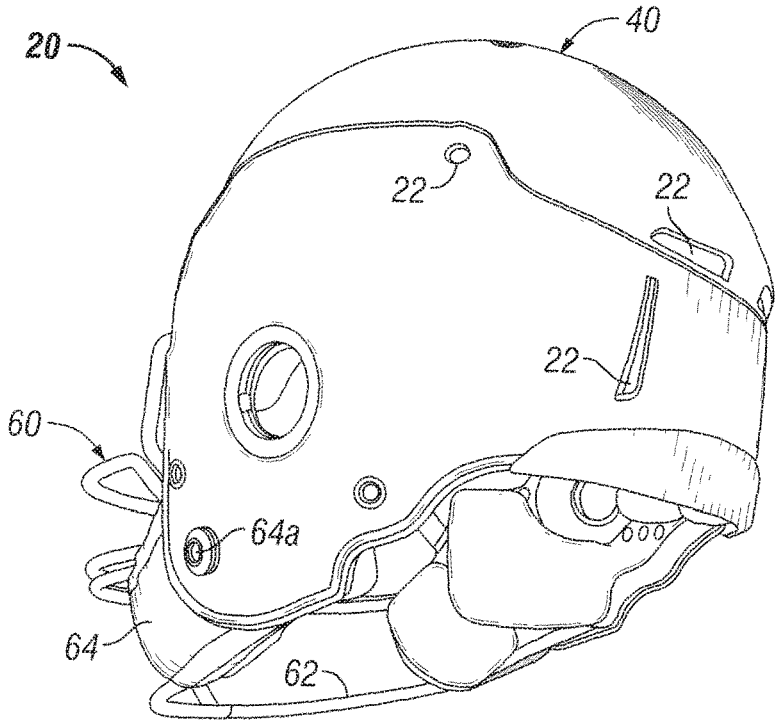
FIG. 2 is a perspective view from a rear and side of the protective helmet of FIG. 1.

As discussed above, the outer shell assembly 40 may comprise a plurality of shell panels 42. As one example, the outer shell assembly 40 may comprise five separate panels forming the outer shell: a front panel, a top or crown panel, a left side panel, a right side panel, and a back panel. An example of a four panel outer shell assembly 40 is a combined front and crown panel, left and right side panels, and a back panel as shown in FIGS. 1 and 2. An example of a three panel outer shell assembly 40 is a front panel, a crown panel and a combined sides and back panel. It is to be understood that the number and type of panels described above is merely exemplary, and is not intended to limit the scope of the present invention.

A multi-panel outer shell assembly 40 preferably allows limited relative movement between adjacent panels 42. The adjacent panels 42 are preferably not secured to each other, but instead are secured to the external energy absorbing layer 50 or the inner shell 30. The individual panels 42 may be directly secured to the energy absorbing layer 50 as described above. One or more of the individual outer shell panels 42 are allowed to move relative to the inner shell 30 as a result of being attached to the external energy absorbing layer 50 and independent from the inner hard shell 30.

Individual panels 42 can be designed, modified or customized for different players or player positions such as a football lineman, receiver, or quarterback. For example, a helmet 20 for a defensive tackle can include more upper head protection by protruding the upper surface of the front or crown portion. Alternatively or additionally, the hardness of the panels may be varied.

In an alternate embodiment, the external energy absorbing layer 50 comprises multiple individual energy absorbing layer segments corresponding substantially to the shape and size of the multiple shell panels 42. For example, the front shell panel would have an energy absorbing layer segment substantially corresponding to the size and shape of the front shell panel. In this embodiment, the energy absorbing characteristics and properties of each shell panel as well as each energy absorbing layer segment can be designed and customized for the desired properties, for individual players, and/or for different player positions.

As shown in FIG. 2, the helmet 20 includes a plurality of air vents 22 located through the front, top, and back of the helmet 20 to allow for maximum air flow and to circulate the inside helmet air through the air vents.

In certain activities such as football, a face guard system 60 is required to protect the player's face from any impact at the front of the helmet. Face guards and attachment devices for attaching the face guard to the helmet shell are well known to those skilled in the art. FIG. 1 shows a face guard system 60 including a wire face guard 62, preferably made from steel, such as stainless or titanium, and covered by plastic, such as a powder coated plastic. The face guard 62 is preferably pivotally attached to the upper front (forehead) portion of the helmet 20 with fasteners 62*a*, typically screws, as are well known in the art. Referring to FIG. 1, a lower cage portion of the wire face guard 62 is housed in or affixed to a pair of side jaw protector plates 64 which are connected to the base of the inner shell 30 with plate fasteners 64*a*, preferably screws. The side jaw protector plates 64, preferably made out of a lightweight metal or plastic, may be molded to their uniquely designed shape with the lower cage portion of the face guard secured or embedded therein. The jaw protector plates 64 can also be soft coated, or tightened to a specific torque for added energy absorption. Preferably, a pair of jaw pads 24*j* (FIGS. 3 and 4) adjacent the side jaw protector plates 64 provide added cushioning and energy absorption at the wearer's jaw area. The jaw pads 24*j* may be removably affixed to the inner shell 30 and/or connected to other internal pads 24 or may be attached to the side jaw protector plates 64. The left and right removable side jaw protector plates 64 reduce the g-forces from side jaw impact. The face guard 62 can also be styled for different player positions, needs or player specifications.

The face guard system 60 shown and described is beneficial because, in the event of a player injury, the face guard 62 is quickly and safely removable by removing the pair of plate fasteners 64*a*. With the fasteners 64*a* removed, the face guard 62 with side jaw protector plates 64 can be pivoted, about the face guard fasteners 62*a*, away from the player's face. The face guard 62 can be fully removed by removal of the top two face guard screws 62*a* at the forehead.

Although not shown, it is also to be understood that the protective helmet 20 may include a chin protector with a chin strap. Such features are well known and understood to those skilled in the art.

Preferably, the padding including the air impact cell system for the helmet 20 is a medical grade polymer such as thermoplastic urethane ("TPU"). Thus, the padding and air impact cell system is antifungal and will not freeze, harden, melt, crack, or leak.

Figure 7:
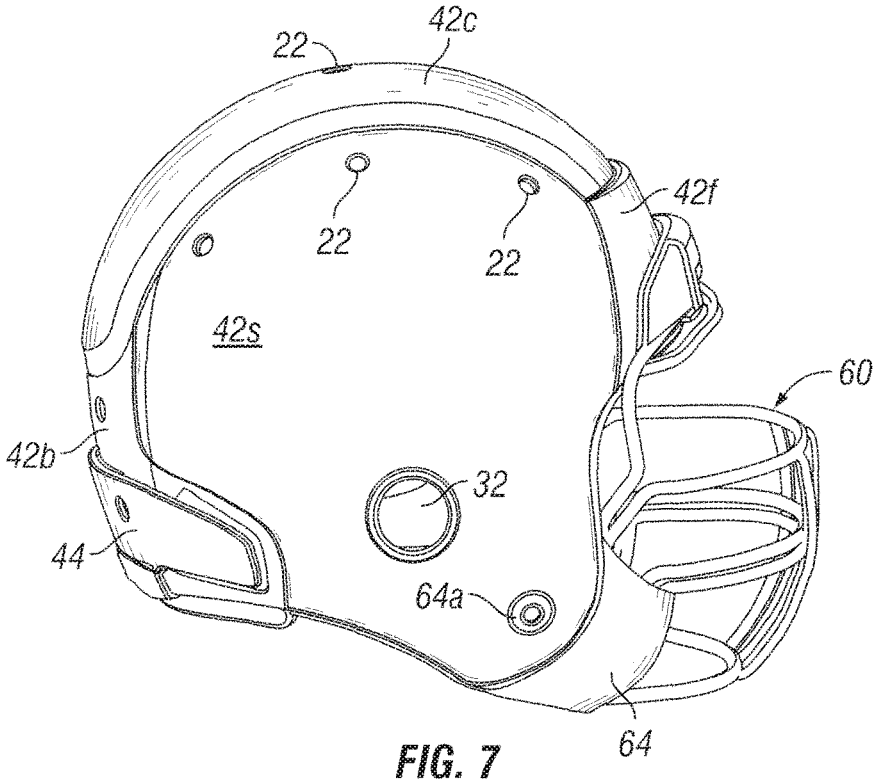
FIG. 7 is a side perspective view of an alternate embodiment of the protective helmet.

An alternate embodiment of the protective helmet 20 is shown in FIG. 7. The outer shell assembly 40 includes a front panel 42*f*, a crown panel 42*c*, two side panels 42*s* and a back panel 42*b*. The separate front outer shell panel 42*f* includes a surface formed to accommodate additional energy absorbing padding for increased impact absorption as might be desirable by a football lineman. Additionally, the back panel 42*b* is shown having an external padding zone 44 as might be desirable by a wide receiver. Stylized external padding can be redesigned at any other point, or, area outside of the outer shell. Dimensions of the individual components can be changed to accommodate for different fit and design of the helmet.

Another preferred embodiment of the present invention is illustrated in FIGS. 8-12. The protective helmet, generally referred to as reference number 120, is again shown as a football helmet although it is to be understood that the present invention is not limited to football.

The protective helmet 120 is similar in many respects to protective helmet 20. The protective helmet 120 includes inner shell 130, outer shell assembly 140, one or more internal pads or layers of internal padding 124 attached to the inner shell 130, and an external energy absorbing layer 150 positioned between the inner shell 130 and outer shell assembly 140.

Figure 11:
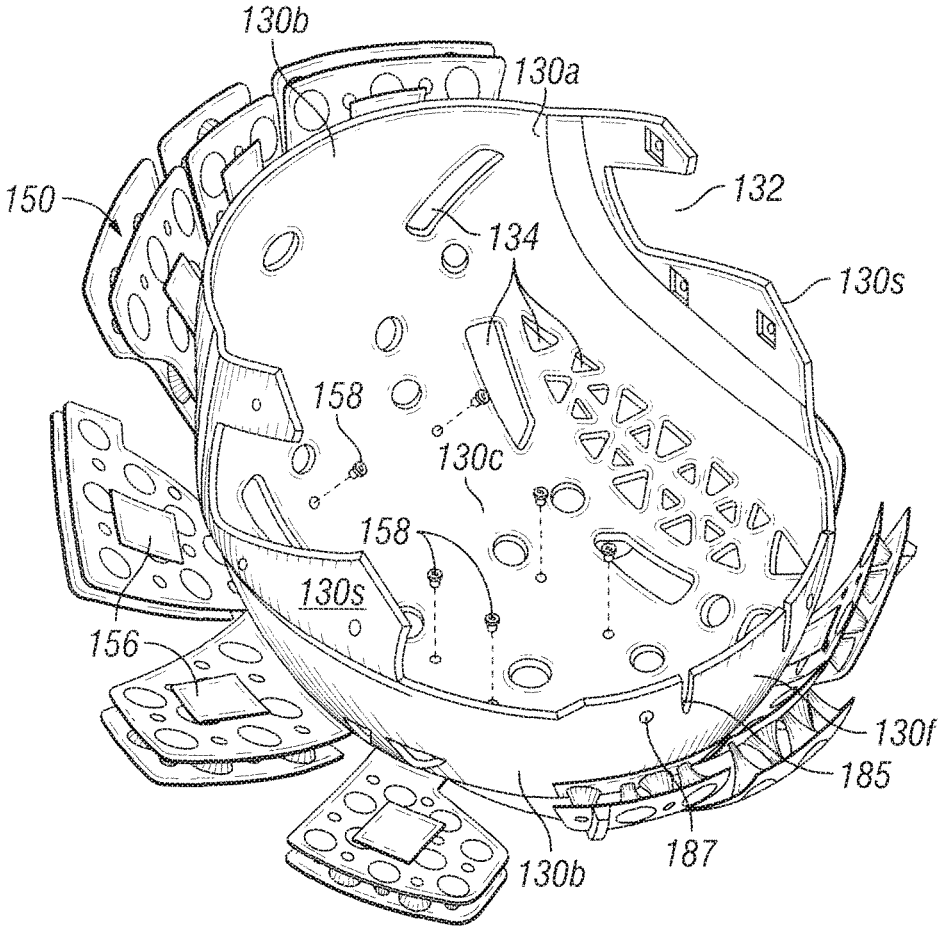
FIG. 11 is an exploded perspective view showing the connection of the external energy absorbing layer to the inner shell.

Referring to FIG. 11, the inner shell 130 includes an inner surface 130*a* and an outer surface 130*b*. The inner shell 130 is preferably a rigid shell and includes a front portion 130*f*, side portions 130*s*, a crown portion 130*c* and a rear portion 130*r*. Preferably, the side portions 130*s* extend downwardly and forwardly to cover the wearer's ears and a portion of the wearer's cheeks. The inner shell 130 includes a pair of ear holes or slots 132. The inner shell 130 is preferably molded into the desired shape and made from the materials described above. The inner shell 130 has a plurality of vent openings 134 therethrough for purposes of air ventilation.

Figure 10:
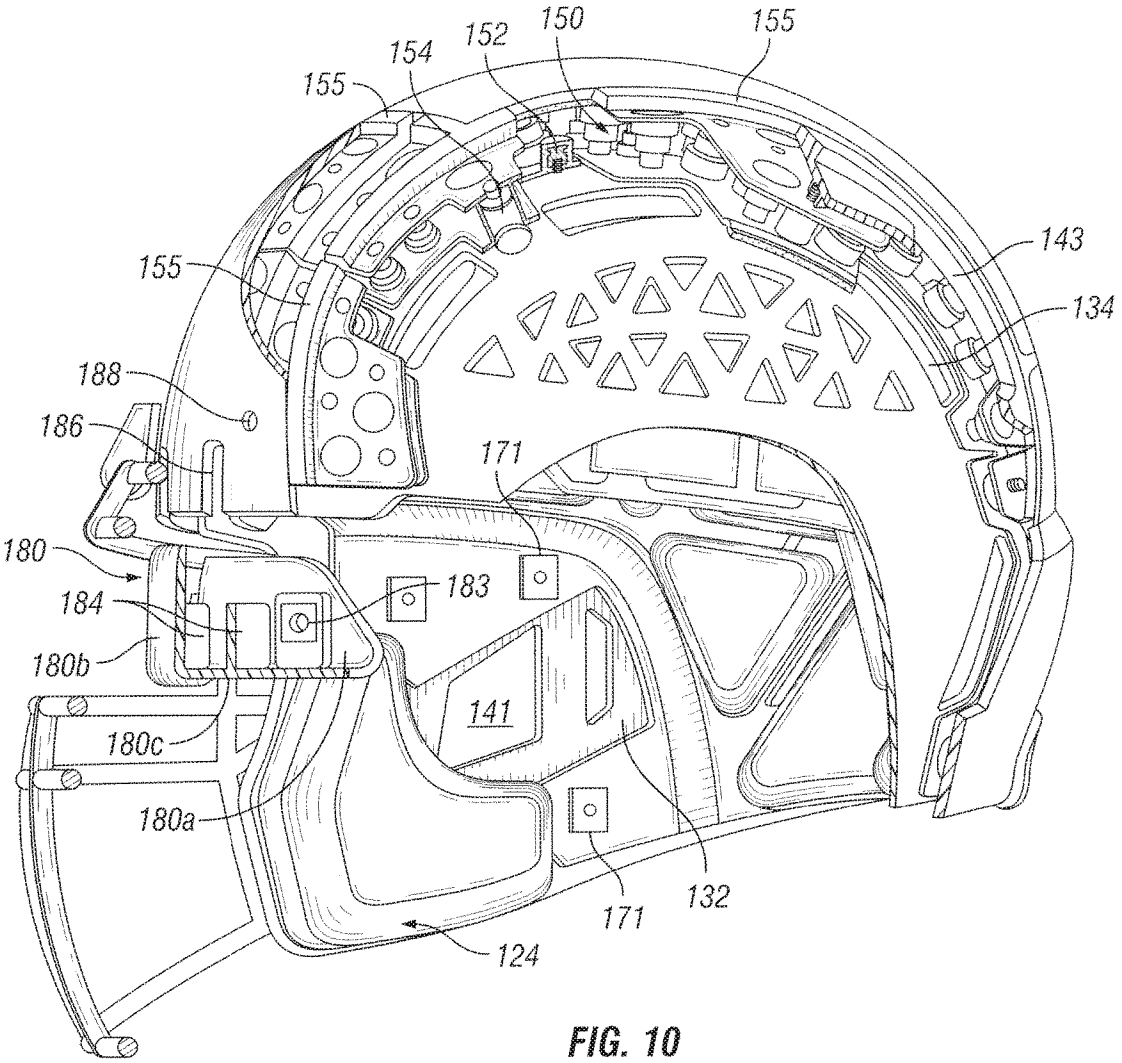
FIG. 10 is a side view similar to FIG. 9 having cutaway sections illustrating internal details of the assembly.

Referring to FIGS. 10 and 11, the external energy absorbing layer 150 may include a cell system comprising a layer of mini air or gel cells sandwiched between the inner shell 130 and the outer shell assembly 140. The air cell padding may be formed in one or more perforated pads or blankets. The padding may be individual pads or a plurality of interconnected pads. The external padding layer 150 is fastened to the outer surface 130*b* of the inner shell 130. Preferably, the external padding layer 150 is attached to the inner shell 130 with hook and loop fasteners 156, such as Velcro® material, and a plurality of fasteners such as screws 158 as shown in FIG. 11. Velcro® is the registered trademark of Velcro Industries B.V. of Netherlands Antilles. The external padding layer 150 preferably include a plurality of inner shell attachment points 152 and outer shell attachment points 154. For example, the inner shell attachment point 152 may comprise a plastic anchor insert molded in the external padding layer 150 for receiving the fastener 158 as shown in FIG. 10. Preferably, both the internal padding layer 124 and the external padding layer 150 include open spaces over the large vent openings 134 for purposes of ventilation.

Figure 13:
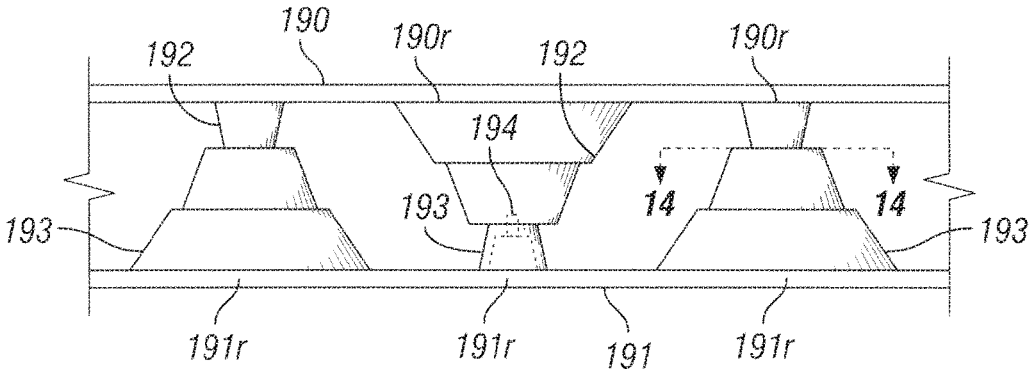
FIG. 13 is a plan view of exemplary embodiment of the external energy absorbing layer.

Preferably, the external padding layer 150 is made of a flexible thermoplastic polymer. Referring to FIG. 13, the preferred padding layer 150 includes a pair of opposing flexible sheets 190 and 191 having a plurality of indentations 192 and 193, respectively, projecting toward the opposing sheet. The indentations 192, 193 are preferably hollow and may comprise a variety of shapes and sizes. The indentations 192, 193 define a spatial relationship between the opposing sheets 190 and 191. Preferably, the indentations 192 and 193 form outwardly facing recesses 190*r* and 191*r*, respectively, in the opposing sheets 190 and 191. Referring to FIG. 13, the indentations 192 in the upper sheet 190 contact or abut the indentations 193 in the lower sheet 191. The indentations 192 and 193 may be joined or adhered to one another. Preferably, an orifice 194 extends through the walls of the abutting indentations to allow for the passage of a fluid, typically air. Air also preferably fills the remaining space between the two opposing sheets 190 and 191. The indentations are designed to partially collapse upon a threshold amount of an applied force and return to their original position upon removal of the force. Preferably, the abutting indentations do not contact adjacent indentations during the compression of the padding 150.

Figure 14:
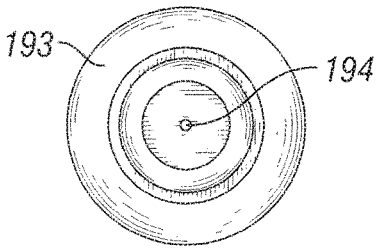
FIG. 14 is a view taken along lines 14-14 of FIG. 13.
Figure 15:
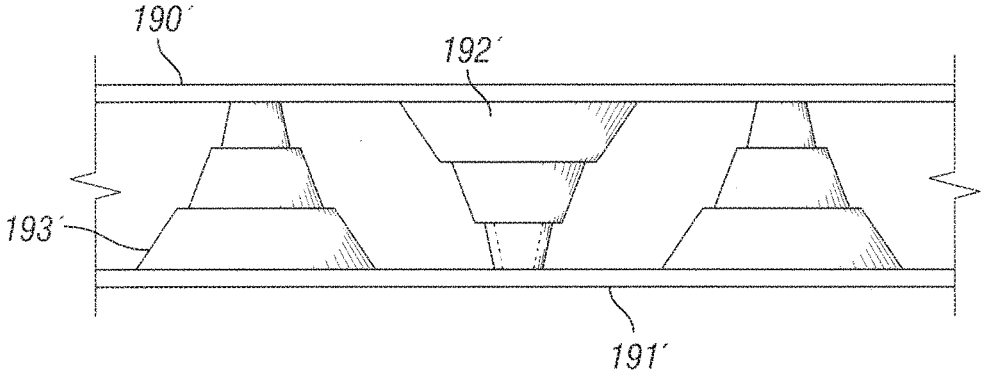
FIG. 15 is a plan view of an alternate embodiment of the external energy absorbing layer.

The size, shape, height and pattern spacing of the indentations 192, 193 can take on many forms. The indentations shown in FIGS. 13 and 14 are depicted as truncated, generally conical shapes with the larger indentations including at least one step transition. The large and small indentations 192 being spaced alternately in the upper sheet 190 and positioned in a grid-like manner. As shown in FIG. 13, the lower sheet 191 includes similar alternately spaced large and small indentations shifted such that the large indentations 193 in the lower sheet 191 oppose the small indentations 192 in the upper sheet 190. In FIG. 15, the indentations 192' in the upper sheet 190' are identical to the indentations 193' in the lower sheet 191' and extend fully to the opposing sheet without contacting other indentations. A variety of shapes and sizes of indentations can be used. For exemplary and not limiting purposes, the indentations could be hemispherical, elliptical, prismatic, or rectangular. The spacing, shape, size and concentration of the indentations can be varied at different locations to provide the desired resiliency and energy absorption at various locations.

Figure 12:
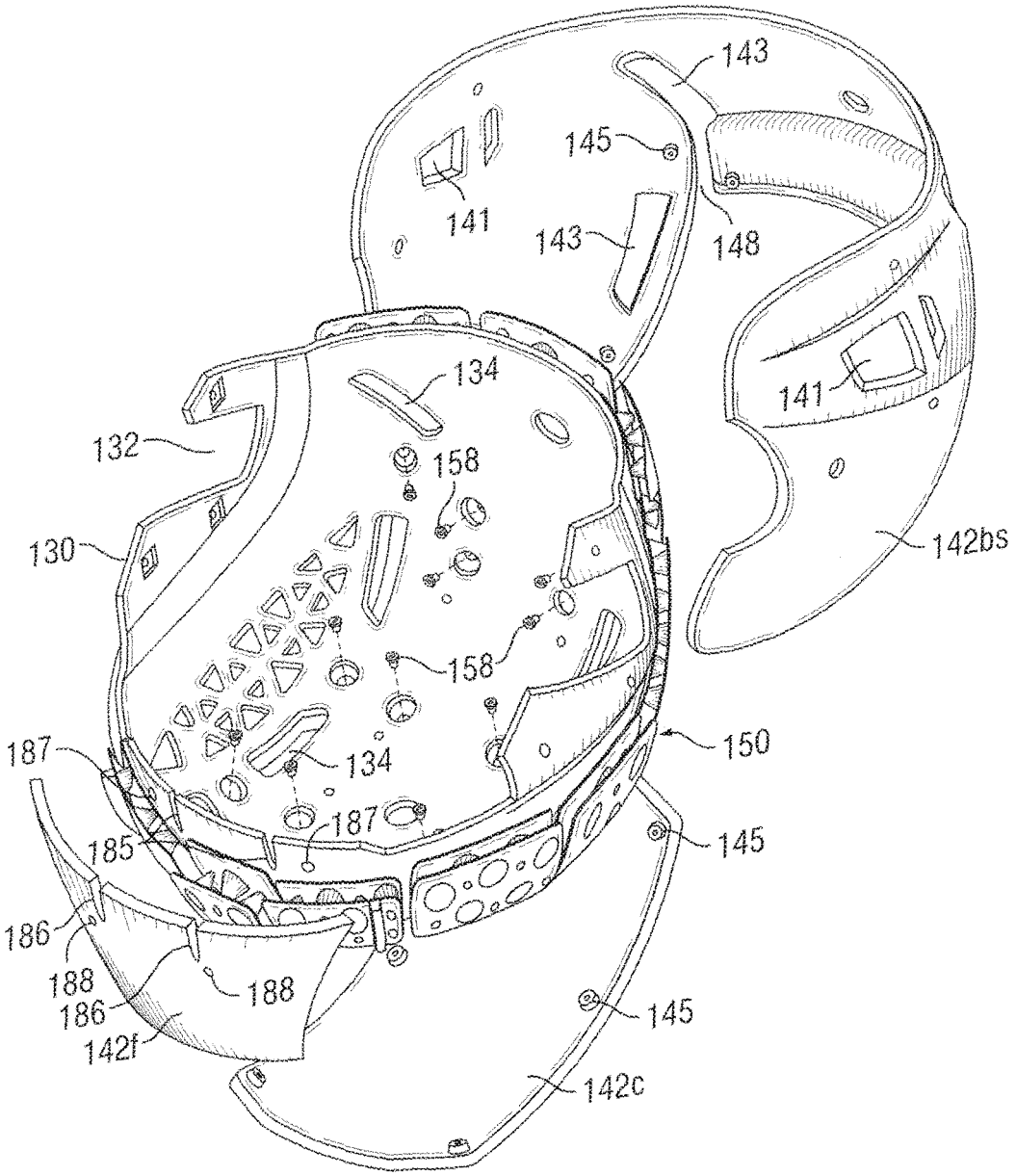
FIG. 12 is an exploded perspective view showing the connection of the outer shell assembly to the external energy absorbing layer.

Referring to FIG. 12, the outer shell assembly 140 comprises three outer shell panels 142: front panel 142*f*, crown panel 142*c* and combined sides and back panel 142*bs*. The combined sides and back panel 142*bs* will be referred to as combination panel 142*bs*. The shell panels 142 are preferably hard and may be made of a rigid material of the type described above. The outer shell assembly 140 protects the external energy absorbing layer 150.

The combination panel 142*bs* includes a pair of ear openings that align with the ear slots 132 of the inner shell 130 upon assembly of the helmet 120 as shown in FIG. 10. The combination panel 142*bs* also includes vent openings 143 that align with the larger vent openings 134 of the inner shell 130. The combination panel 142*bs* also includes a pair of slot channels or slits 148. The slot channels 148 are shown joined with a lower pair of vent openings 143. As a result of the slot channels 148, the back portion of panel 142*bs* is a pressable or flexible section allowing independent deflection into the padding layer beneath the flexible section, thus, not allowing the impact energy to transfer over the large portion of the combination panel 142*bs*.

Referring to FIG. 12, outer shell panels 142 preferably include screw bosses 145 molded in the outer shell panels 142. The outer shell attachment points 154 comprise a channel in the external energy absorbing layer 150 aligned with a corresponding opening in the inner shell 130. Screws or fasteners 159 secure the outer shell panels 142 to the external padding layer 150 as shown in FIGS. 10 and 12.

Preferably, the outer surface of the external padding layer 150 includes a plurality of raised ridges 155 positioned between the adjacent outer shell panels 142. The ridges 155 are preferably flush with the outer surface of the outer shell panels 142 and fill in the space between the panels 142. The ridges 155 also preferably exist in the slotted channels 148 of the combination panel 142*bs*. The ridges 155 eliminate any gap between panels 142 while also providing a relatively smooth exterior surface. For increased strength, the outer shell panels 142 may include a locally increased thickness at or adjacent to larger vent openings 143 and the seams filled by the ridges 155.

In the preferred embodiment of FIGS. 8-12, the outer shell assembly 140 is attached to the external energy absorbing layer 150 and is only attached to the inner shell 130 at, or around the ear holes 141. A plurality of screws 170 (FIG. 9) and nuts 171 (FIG. 10) fasten the outer shell assembly 140 to the inner shell 130. However, it is to be understood that the outer shell assembly 140 does not have to be directly attached to the inner shell 130, but instead can be indirectly attached to the inner shell 130 via the external energy absorbing layer 150 as described above.

A front plate assembly 180 is fastened to the front portion of the helmet 120. Referring to FIG. 10, the front plate assembly 180 is generally U-shaped in cross-section having inner and outer legs, 180*a* and 180*b* respectively, joined by a lower segment 180*c*. The inner and outer legs 180*a*, 180*b* have an arcuate shape conforming to the curvatures of the lower front portion of the inner shell 130 and the lower portion of the front panel 142*f*. The inner and outer legs 180*a* and 180*b* are also joined by a pair of upright ribs 184. The inner leg 180*a* preferably includes a pair of nuts 183. The front plate assembly 180 is preferably made from a material suited for tensile loading, such as Surlyn® material. Surlyn® is the registered trademark of E. I. du Pont de Nemours and Company of Wilmington, Del.

Referring to FIG. 12, the inner shell 130 and the outer shell front panel 142*f* each include a pair of slots 185 and 186, respectively, adapted to receive the ribs 184 of the front plate assembly 180. Additionally, the inner shell 130 and the outer shell front panel 142*f* each include a pair of holes 187 and 188, respectively, adapted to receive fasteners as will be explained below.

With reference to FIG. 10, the front plate assembly 180 is mounted to the inner shell 130 with fasteners such as screws inserted through nuts 183. Preferably, additional fasteners and nuts attach the top mounts 164 and the front panel 142*f* to front plate assembly 180. The front plate assembly 180 is mounted to the inner shell 130 and separately mounted to the outer shell front panel 142*f*. Preferably, the fasteners securing the face guard top mounts 164 also secure the front panel 142*f* to the front plate assembly 180.

Figure 8:
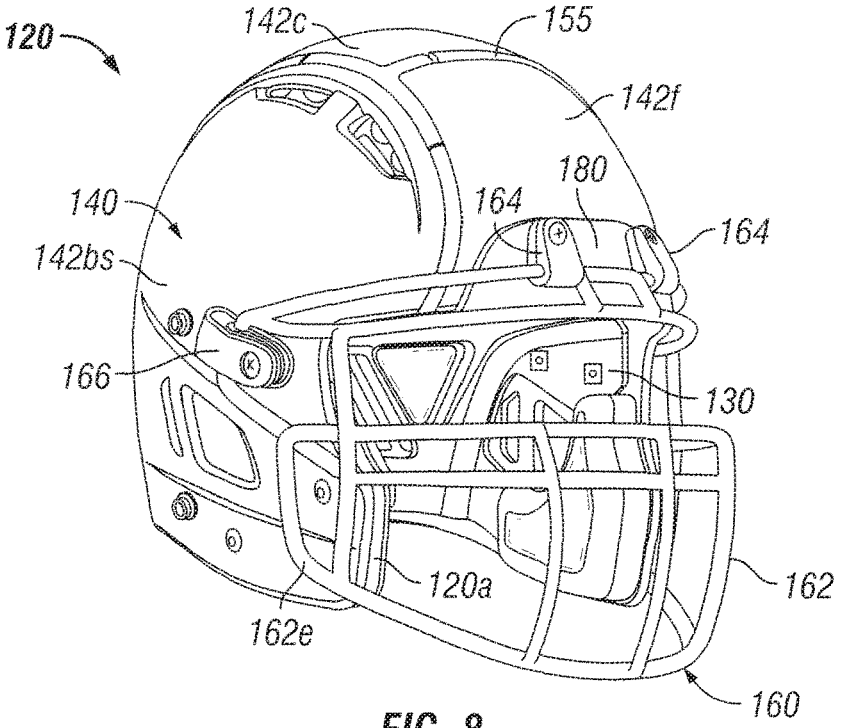
FIG. 8 is a perspective view from the front and side of another preferred embodiment of the protective helmet according to the present invention.
Figure 9:
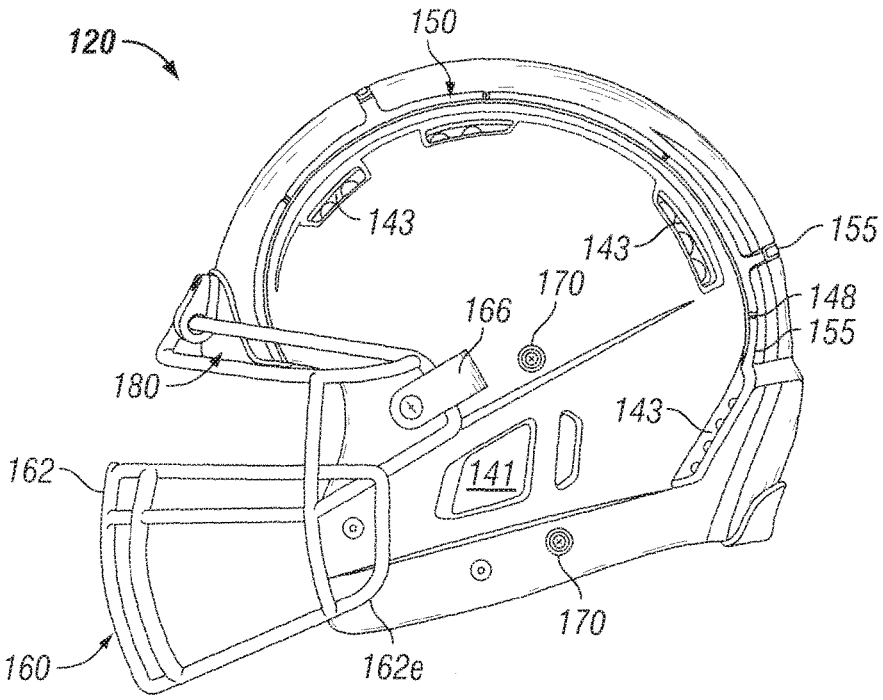
FIG. 9 is a side view of the protective helmet of FIG. 8.

Referring to FIGS. 8 and 9, an alternative or modified face guard system 160 is disclosed. The face guard system 160 includes a wire face guard 162 preferably made from steel and covered by plastic. Preferably, the wire face guard 162 is formed by bending a certain guage metal wire and welding the wire pieces together. The face guard 162 preferably includes a lower jaw extension 162*e* extending beyond the lower front edge 120*a* of the helmet 120. The face guard system 160 includes a pair of upper side mounts 166 secured to the helmet 120 with a fastener. The face guard 162 is preferably pivotally attached to the front plate assembly 180 with one or more top mounts and fasteners 164, typically screws.

In this preferred embodiment, the faceguard system 160 has upper side mounts 166 with the face guard 162 extending over the jaw line to bolster the side and lower jaw impact protection of the helmet 120. This helps prevent the lower jaw sides of the helmet from flexing inwards from impact and thus reduces impact at the player's lower jaw. The face guard 162 protects from side, top and lower impacts with the pair of upper side mounts 166. It is to be understood that the face guard 162 may take other shapes or geometries; however, it needs to maintain the necessary dimensions/geometry to accommodate the proper fasteners, and to extend far enough to cover and protect the lower jaw area of the helmet shell.

Figure 16:
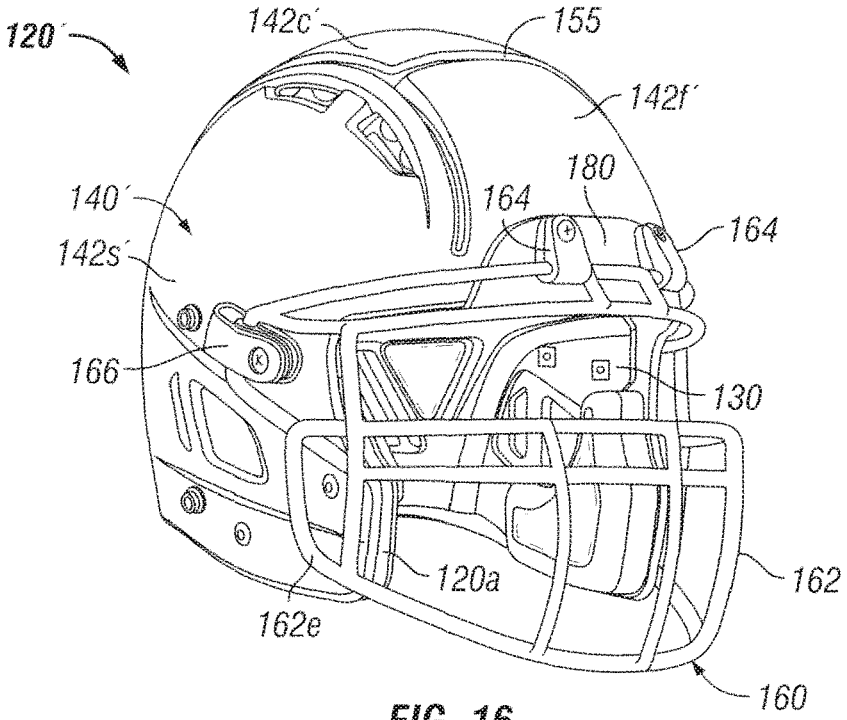
FIG. 16 is a perspective view from the front and side of another preferred embodiment of the protective helmet according to the present invention.
Figure 17:
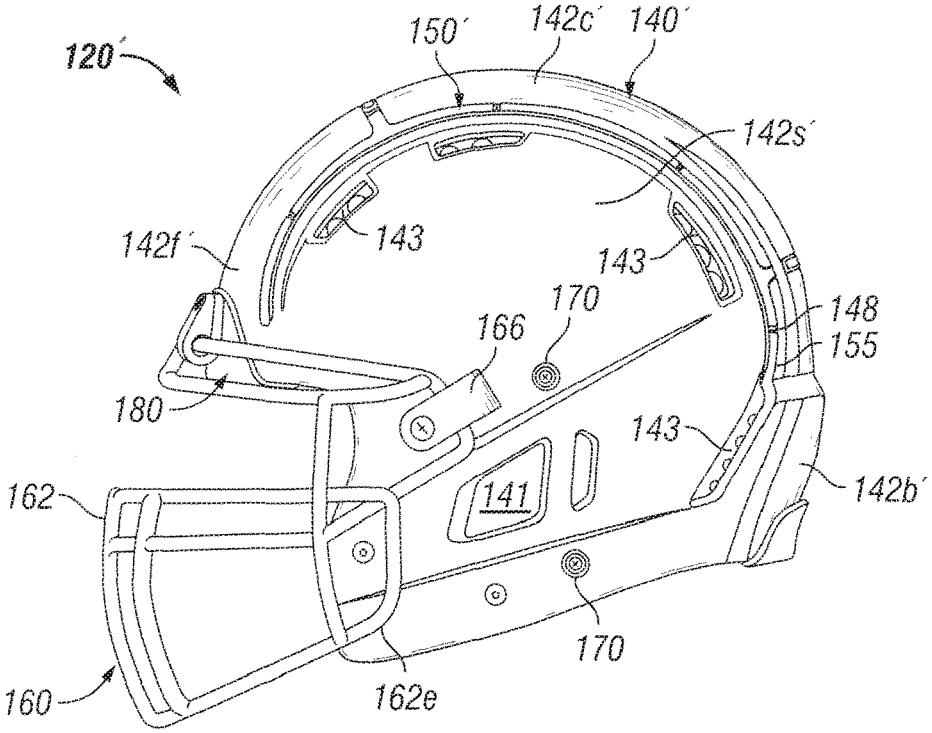
FIG. 17 is a side view of the protective helmet of FIG. 16.

FIGS. 16 and 17 show another embodiment of the protective helmet, referred to as 120'. The helmet 120' is very similar to the helmet 120 shown in FIGS. 8 and 9. The primary difference in the helmet 120' is the outer shell assembly 140'. The outer shell assembly 140' comprises a one piece outer shell 142' having a plurality of slits therethrough creating one or more pressable or flexible sections that dampen impact, and allow for bend or flex into the external energy absorbing layer for more impact shock absorption. The outer shell front segment 142*f* and the outer shell back segment 142*b*' are joined to the outer shell side segments 142*s*' and the outer shell crown segment 142*c*' is formed with or joined to the back segment 142*b*'.

The outer shell segments are connected to the outer padding as described above to dampen the impact energy before it reaches the inner shell. Preferably, the hard outer shell is made by injection molding of certain plastics.

It is the desire that the protective helmet of the present invention provides a degree of protection to its wearer by reducing the g-forces to the head upon impact. It is to be understood that dimensions, surface forms, and internal padding can be changed to accommodate enhanced protection, thus providing safer operation of the helmet. The protective helmet can also be used for various other sports and activities not mentioned previously including, but not limited to, skiing, auto racing, and military impact training exercises.

While the invention has been described in detail above with reference to specific embodiments, it will be understood that modifications and alterations in the embodiments disclosed may be made by those practiced in the art without departing from the spirit and scope of the invention. All such modifications and alterations are intended to be covered. In addition, all publications cited herein are indicative of the level of skill in the art and are hereby incorporated by reference in their entirety as if each had been individually incorporated by reference and fully set forth.

We claim:

1. A football helmet comprising:

a one-piece shell comprising:

a crown portion defining an upper region of the shell;

a front portion forward of the crown portion;

a left side portion and a right side portion each being lateral of the crown portion, and each having an ear flap; and a rear portion rearward of the crown portion; and an energy absorbing layer coupled to an inner surface of the shell;

wherein the shell has a non-linear channel spaced entirely from an edge of the shell and the non-linear channel partially surrounds and defines a shell section within the front portion that is moveable relative to a remainder of the shell upon the shell section receiving an impact energy to dampen the impact energy.

2. The football helmet of claim 1, wherein the non-linear channel forms a continuous gap.

3. The football helmet of claim 2, wherein the continuous gap has a U-shaped configuration.

4. The football helmet of claim 1, wherein the shell section comprises a living hinge operably coupling the shell section to the remainder of the shell, the living hinge allowing the shell segment to elastically deform when the shell receives the impact energy.

5. The football helmet of claim 4, wherein the shell section is elastically deformed inward into the energy absorbing layer.

6. The football helmet of claim 1, wherein movement of the shell section upon receipt of the impact energy causes compression of the energy absorbing layer.

7. The football helmet of claim 1, further comprising an inner shell coupled to at least a portion of an inner surface of the energy absorbing layer.

8. The football helmet of claim 7, wherein the inner shell is a rigid shell.

9. The football helmet of claim 1, wherein the non-linear channel defines the shell section entirely within the front portion of the shell.

* * * * *